US008245963B2

(12) United States Patent
Devroe et al.

(10) Patent No.: US 8,245,963 B2
(45) Date of Patent: Aug. 21, 2012

(54) GRAIN SIZE SELECTION AND/OR MATTER DRYING APPARATUS

(75) Inventors: Sébastien Devroe, Barlin (FR); Alain Cordonnier, Villeneuve d'Asq (FR); Pascal Marechal, Villeneuve d'Asq (FR)

(73) Assignee: FIVES FCB Societe Anonyme, Villeneuve d'Ascq (FR)

( * ) Notice: Subject to any disclaimer, the term of this patent is extended or adjusted under 35 U.S.C. 154(b) by 206 days.

(21) Appl. No.: 12/447,973

(22) PCT Filed: Nov. 20, 2007

(86) PCT No.: PCT/FR2007/001901

§ 371 (c)(1),
(2), (4) Date: Jan. 30, 2010

(87) PCT Pub. No.: WO2008/068432

PCT Pub. Date: Jun. 12, 2008

(65) Prior Publication Data

US 2010/0133369 A1 Jun. 3, 2010

(30) Foreign Application Priority Data

Nov. 20, 2006 (FR) ..... 06 10144

(51) Int. Cl.
*B02C 23/20* (2006.01)

(52) U.S. Cl. ..... 241/79.1; 34/588; 209/138; 209/139.1

(58) Field of Classification Search ..... 241/40, 241/65, 80, 79.1; 34/369, 436, 588, 165; 209/138, 139.1

See application file for complete search history.

(56) References Cited

U.S. PATENT DOCUMENTS

| | | | | | |
|---|---|---|---|---|---|
| 271,604 | A | * | 2/1883 | Cook | 34/171 |
| 1,861,248 | A | * | 5/1932 | Stebbins | 209/139.1 |
| 2,808,213 | A | * | 10/1957 | Morrison | 241/40 |
| 2,813,318 | A | * | 11/1957 | Horth | 209/139.1 |
| 2,949,245 | A | * | 8/1960 | Faulk | 241/5 |
| 3,975,263 | A | | 8/1976 | Elo | |

FOREIGN PATENT DOCUMENTS

| | | | |
|---|---|---|---|
| EP | 0982082 | | 3/2000 |
| GB | 767646 | | 2/1957 |
| GB | 2193448 | | 2/1988 |
| JP | 52037258 | * | 3/1977 |

* cited by examiner

*Primary Examiner* — Mark Rosenbaum
(74) *Attorney, Agent, or Firm* — Young & Thompson

(57) ABSTRACT

A grain size and/or pulverulent-matter drying apparatus for the treatment of suspended mineral particles, at least 90% in weight of which have a size less than 60 mm, primarily includes a substantially vertical gas pipe with an ascending flow provided with a gas inlet, a lower opening and an upper opening between which a supply opening is also provided for insertion of matter. A portion of the matter, or so-called "fines", can escape with the gas through the upper opening due to the bearing capacity of the ascending flow, while another coarser portion of the matter is not carried away by the gas and falls into the lower opening. The apparatus also has a device for creating turbulence, which favors the separation of the different grain sizes and the suspension of matter, provided at the internal wall of the pipe and located between the lower opening and the supply opening.

18 Claims, 7 Drawing Sheets

GRAIN SIZE SELECTION AND/OR MATTER DRYING APPARATUS

CROSS-REFERENCE TO RELATED U.S. APPLICATIONS

Not applicable.

STATEMENT REGARDING FEDERALLY SPONSORED RESEARCH OR DEVELOPMENT

Not applicable.

NAMES OF PARTIES TO A JOINT RESEARCH AGREEMENT

Not applicable.

REFERENCE TO AN APPENDIX SUBMITTED ON COMPACT DISC

Not applicable.

BACKGROUND OF THE INVENTION

1. Field of the Invention

The present invention relates to a grain size selection and/or matter drying apparatus for the treatment of suspended mineral particles whereof at least 90% in weight have a size less than 60 mm.

2. Description of Related Art Including Information Disclosed Under 37 CFR 1.97 and 37 CFR 1.98

In mineral matter crushing and/or drying workshops, "in-line" suspended drying apparatuses are commonly used, applied to matter whereof the average grain size is smaller than 10 mm. These apparatuses, wherein thermal exchange is mass-based, via drying, and is very quick, are often qualified as "flash" apparatuses. Such systems in the form of an arrangement of a vertical hot gas pipe have been described in publications and in particular B. Reinhardt, Ph. Duhamel, R. Evrard, A. Cordonnier—Le sechage flash (flash drying)—Seminaire de la Societe de l'Industrie Minerale (Seminar of the Society of Mineral Industry)—Dijon, 9 Oct. 1999.

For suspending the major portion of matter to be treated, and enabling contact with the hot gases for drying said matter, an ascending hot gas flow is created whereof the speed is of the order of 30 to 40 m/s, thus causing significant load loss.

Although as a matter of principle, in such systems, the coarsest fractions of matter are not carried away, these apparatuses are not considered as grain size selectors. Indeed, when these apparatuses are filled with a coarse fraction composed of particles of various diameters, generally, the major portion of the fraction falls, without separation or suspension of the finest particles contained therein.

Conversely, it also happens that coarse fractions of smaller dimensions are carried away due to the high intensity of the ascending flow. The selection power of these machines, which expresses the capacity to separate matter in relation to the size of their grains, is hence poor.

Moreover, the presence of a coarse fraction in too large quantity disturbs the operation of these apparatuses as well the operation of the plant inside which they are installed. For instance, in the case of a crushing plant for the production of cement, the apparatus will disturb the operation of the aeraulic separator situated downstream thereof. Indeed, when the drying apparatuses are loaded with a large coarse fraction, the apparatus becomes unstable, wherein the ascending flow necessary to the suspension of matter is pumping jerkily.

The aim of the present invention is to provide a grain size selection and/or pulverulent matter drying apparatus for the treatment of suspended mineral particles whereof at least 90% in weight have a size less than 60 mm, which operates in-line and stably for application to materials whereof the grain size spectrum is wide.

Another aim of the present invention is to provide a grain size selection and/or drying apparatus enabling proper separation of the particles, which can then be suspended.

Another aim of the present invention is to provide a grain size selection and/or pulverulent matter drying apparatus, constituted mainly of a vertical gas pipe, with small space requirements, in particular with a height substantially smaller than the height of the gas pipe of the "flash" type drying apparatuses known to the man of the art.

Another aim of the present invention is to provide a grain size selection and/or pulverulent matter drying apparatus, operating using an ascending gas flow whereof the speed is vastly lower than the speed of the ascending gas flow of the "flash" type drying apparatuses known to the man of the art, thus reducing the load loss.

Other aims and advantages of the invention will appear during the following description, given solely for informative purposes, and without being limited thereto.

BRIEF SUMMARY OF THE INVENTION

The invention concerns a grain size selection and/or pulverulent matter drying apparatus, for the treatment of suspended mineral particles whereof at least 90% in weight have a size less than 60 mm. The apparatus is primarily constituted of a substantially vertical gas pipe, with an ascending flow, provided with a gas inlet at its base, fitted with a lower opening and an upper opening between which a supply opening is also provided for insertion of matter, in which apparatus a portion of matter, in particular so-called fine, can escape with the gas through the upper opening due to the bearing capacity of said ascending flow, while another portion of the coarser matter is not carried away by said gas and falls into the lower opening.

According to the invention, the apparatus possesses, moreover, means for creating turbulence, which favors the separation of the different grain sizes and the suspension of matter, fastened at the internal wall of the gas pipe, and situated between the lower opening and the supply opening of said pipe.

The invention also relates to a continuous crushing plant, in particular for a cement plant, of closed circuit type, comprising:

- a crusher, in particular of roll or ball type, exhibiting an inlet for products to be crushed and an outlet for crushed products,
- a selector-drier, consisting of a grain size selection and drying apparatus with an ascending flow according to the invention, comprising a lower reject outlet, connected to the inlet to the crusher, an upper outlet for fly matter, between which a matter supply opening is also provided,
- a dynamic selector including at least one matter inlet connected at least to said fly matter outlet from the selector-drier, an outlet for the selected matter, and a reject outlet connected to the inlet to the crusher,
- a filter enabling to filter the gases loaded with the selected matter, connected to the matter outlet of the dynamic selector, the outlet of the crusher being connected to said at least one matter inlet of the dynamic selector, and/or the supply opening of the selector-drier, at least one matter supply unit feeding the inlet to the crusher and/or the supply opening of the selector-drier.

BRIEF DESCRIPTION OF THE SEVERAL VIEWS OF THE DRAWINGS

The invention will be understood better when reading the following description, accompanied by the appended drawings, forming an integral part thereof.

DETAILED DESCRIPTION OF THE INVENTION

The grain size selection and/or pulverulent matter drying apparatus, according to the invention, differentiates from the known "flash" type drying systems, including as a main element for matter suspension, a venturi in the neck of which the speed of the gases is raised to 30-40 m/s. The construction of the venturi implies a total height of the device which is 5 to 6 times the value of the diameter of the vertical pipe.

These "flash" systems enable to process matter whereof the grain size is smaller than 20 mm with a specific concentration does not exceed 2.5 kg/kg gas. Beyond these values, operating instability problems appear.

The grain size selection and/or pulverulent matter drying apparatus, according to the invention, is intended for the treatment of suspended mineral particles whereof at least 90% in weight have a size less than 60 mm.

Figure 1:
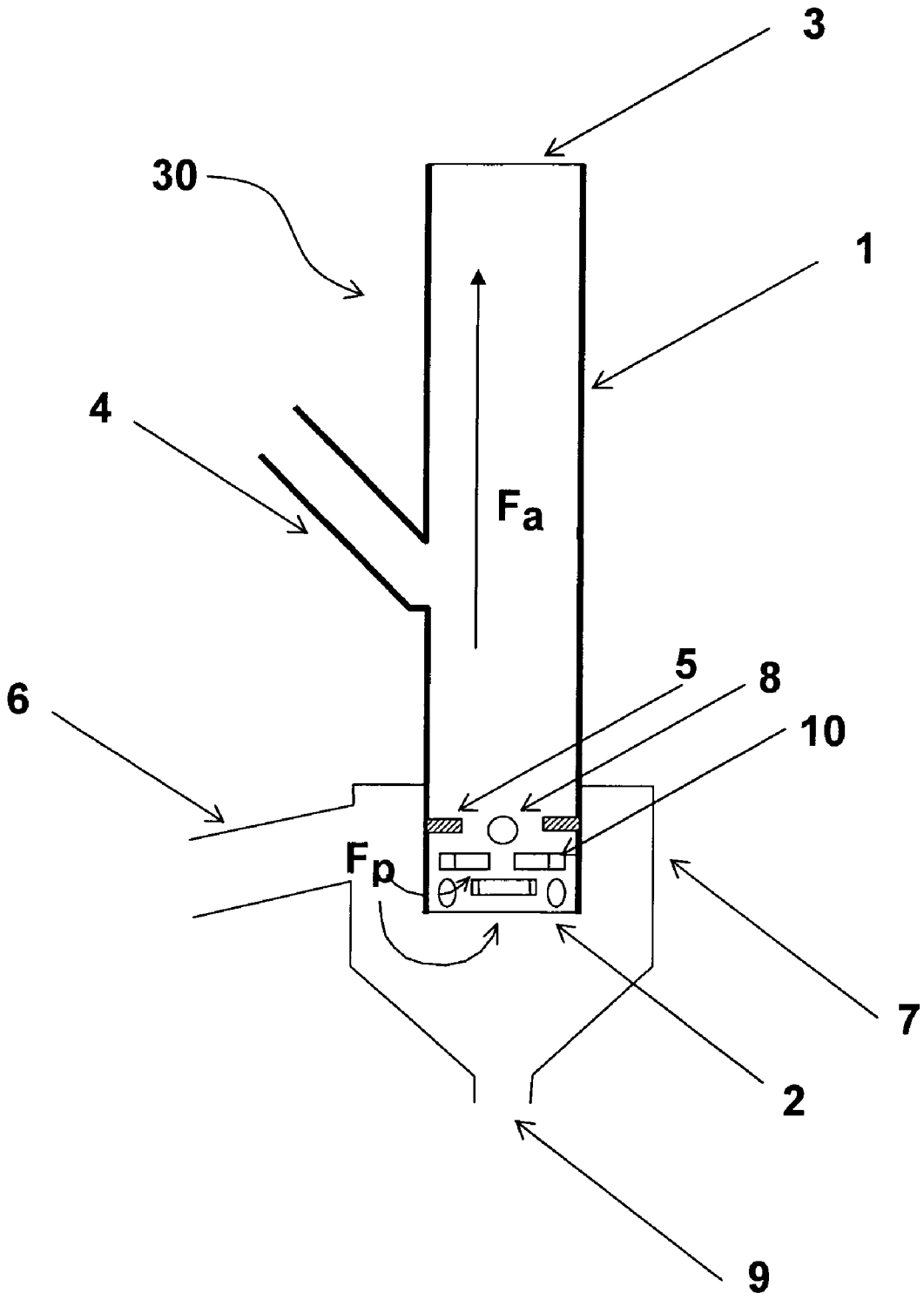
FIG. 1 is a schematic view diagrammatically illustrating a grain size selection and/or drying apparatus according to an embodiment of the invention.
Figure 2:
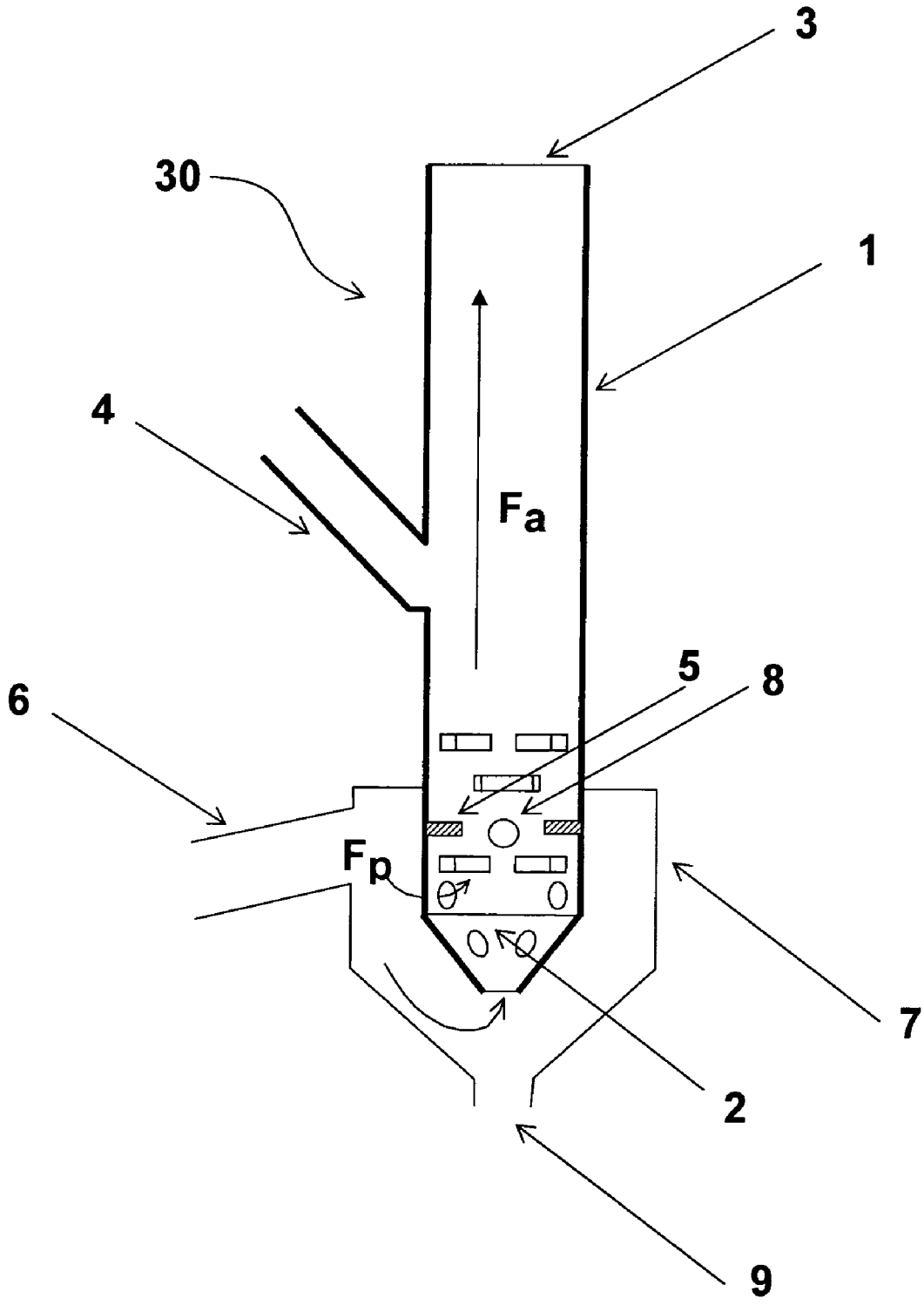
FIG. 2 is a schematic view diagrammatically illustrating a grain size selection and/or pulverulent matter drying apparatus according to a second embodiment of the invention.
Figure 3:
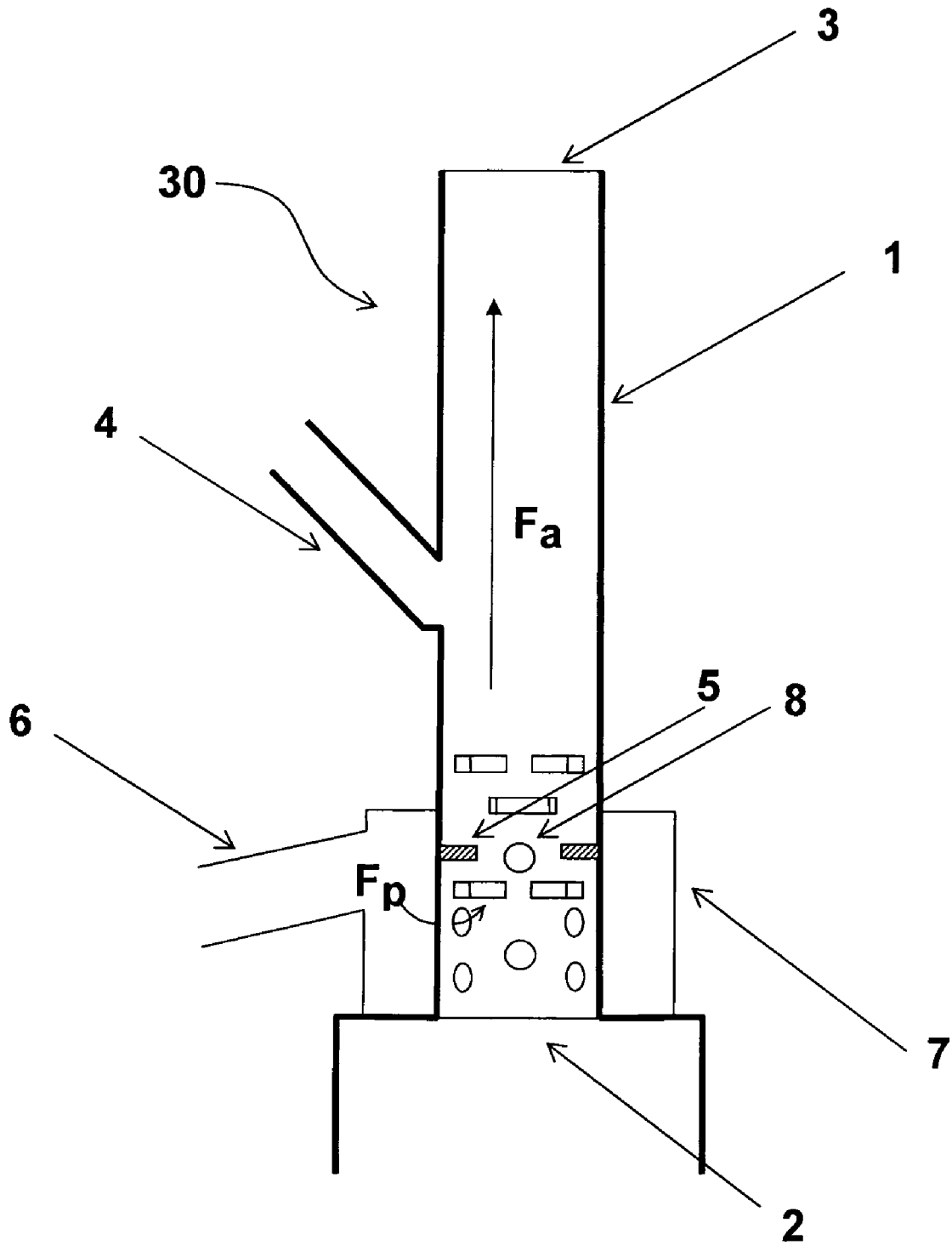
FIG. 3 is a schematic view diagrammatically illustrating a grain size selection and/or pulverulent matter drying apparatus, according to a third embodiment of the invention.

As illustrated according to the embodiments of FIGS. 1 to 3, the apparatus is constituted mainly by a gas pipe 1, substantially vertical, with an ascending flow Fa, provided with a gas inlet at its base.

This pipe may be of substantially circular elliptical or rectangular cross-section. Preferably, the form factor, i.e. the length/width ratio of the dimensions of the section does not exceed three.

This pipe is fitted with a lower opening 2 and an upper opening 3 between which a supply opening 4 is also provided for insertion of matter. The lower opening 2 may be filled with gas in particular through a plenum 7 also called wind box.

A portion of the grain mineral matter, in particular so-called "fines", can escape with the gas through the upper opening 3 due to the bearing capacity of the ascending flow Fa, while another portion of the coarser matter is not carried away by said gas and falls into the lower opening 2.

According to the invention, the apparatus 30 possesses, moreover, means 5 for creating turbulence, which favors the separation of the different grain sizes, as well as the suspension of matter, provided at the internal wall of the gas pipe 1 and situated between the lower opening 2 and the supply opening 4 of the gas pipe 1.

Advantageously, the turbulence enables in particular the separation of particles of various diameters, of a coarse matter fraction, thus enabling suspension and evacuation through the upper opening 3 of the so-called "fines" particles of this fraction, and the fall of the larger-sized particles through the opening 2.

According to an embodiment, in particular illustrated on FIG. 1, the means 5 for creating turbulence may be constituted, at least partially, by obstacles to the ascending gas flow Fa, fastened at the internal wall of the gas pipe 1. In particular, as illustrated on FIG. 1 and on FIG. 5 in detail, the obstacles may be in the form of globally horizontal blades 10, whereof the length is oriented towards the center of the gas pipe 1.

The blades may be arranged at least over two successive levels in height, as illustrated in particular on FIG. 1. Advantageously, the blades may be staggered angularly between two successive levels in height, with, possibly, lateral overlays, forcing in particular the ascending gas flow to zigzag between the blades of different levels.

If the length of the blade is defined along the direction situated towards the center of the gas pipe 1 and the width in the orthogonal direction of the horizontal plane, the length of each blade may represent between 2 and 30% of the free width of the pipe 1 along the axis of the blade.

The sum of the widths of each blade in particular arranged at least at two successive levels in height may represent at least 60% of the peripheral length of the pipe. By peripheral length of the pipe is meant the perimeter of the section of the gas pipe 1, obtained by the intersection of the pipe with a horizontal plane. The sum of the widths of the blades may be advantageously comprised between 120% and 200% of the peripheral length of the pipe.

Figure 5:
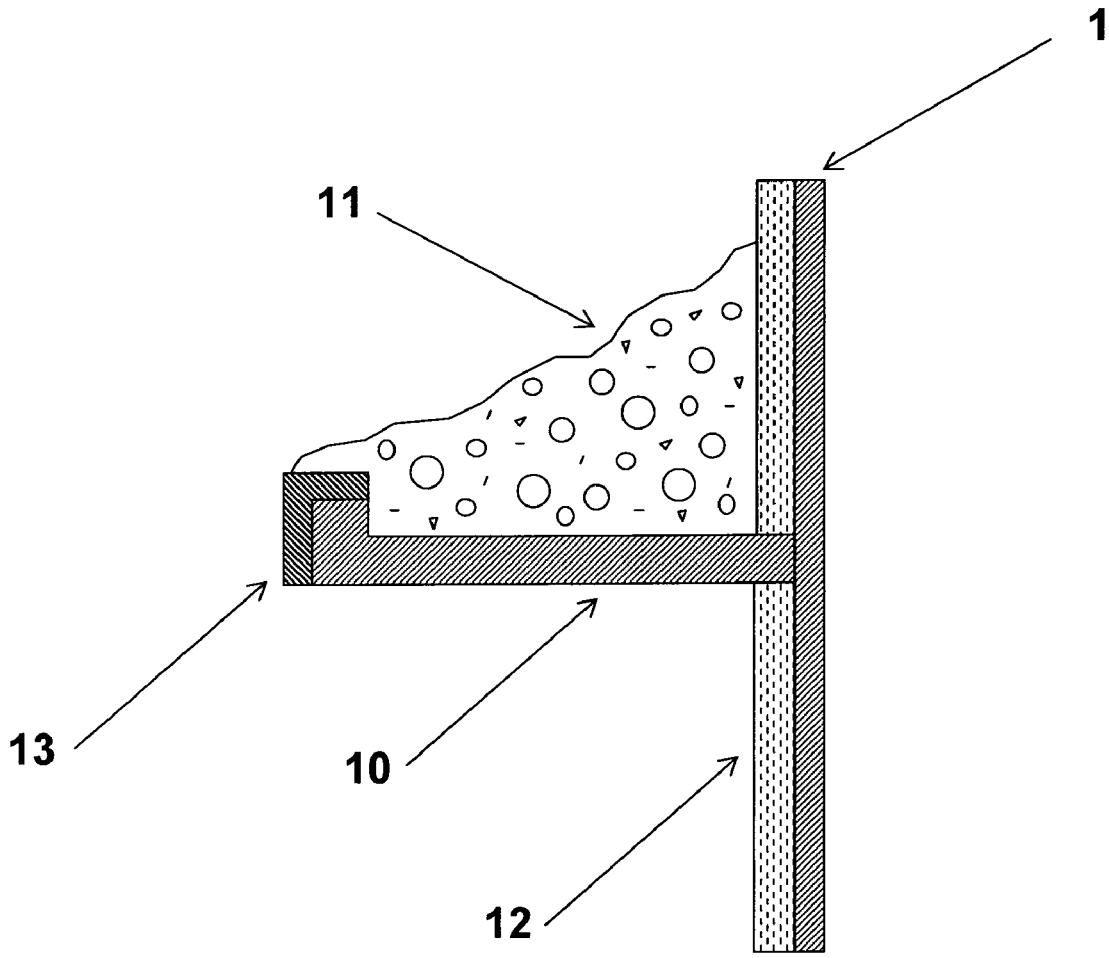
FIG. 5 is a vertical sectional view of the gas pipe, illustrating a blade of an apparatus, in particular as illustrated on FIG. 1.

Advantageously, as illustrated on FIG. 5, the shape and the position of the blades 10 in the gas pipe 1 may be favorable to matter build-up, in particular stagnating matter, on the top of said blades 10 in operating mode, in order to protect said blades against erosion. In particular, the blade may be concave in shape on the top of the blade or still exhibit one or several greater rims, in particular at the end of the blades 13. The end 13 may be protected by a harder matter, the pipe 1 may be coated with an abrasion protection material 12.

Thus, at the point where matter is introduced and due to the presence of coarse fractions whereof the natural fall speed is greater than the ascending speed of the gas, a portion of the matter is not suspended again. The matter mainly falls by sliding along the walls. The matter sliding along the walls is stopped, and the gas turbulence created in the vicinity of the blades enables separation of the diverse grain size fractions present as well as suspension of less coarse matter.

Alternately or additionally to the obstacles on the internal wall of the pipe, in particular to said blades 10, the means 5 for creating turbulence may be constituted, at least partially, by at least one wall gas flow Fp, oriented globally perpendicular to the direction of the ascending flow Fa penetrating in particular radially or tangentially into the internal volume of the gas pipe 1 through orifices 8 in the wall of said gas pipe 1.

The total surface area of the orifices 8 may represent between 15% and 150% of the free section of the pipe 1.

The apparatus may exhibit at least one plenum 7 surrounding the lower portion of the pipe, enabling to feed with gas the lower opening 2 for gas inlet and/or possibly the orifices 8 in the walls of the pipe. In particular, according to a non-illustrated embodiment, the gas inlet may be constituted solely by the lower opening 2. According to the examples of FIG. 1 or 2, the gas inlet of the pipe is formed of the lower opening 2 and the wall orifices 8. According to the example of FIG. 3, the gas inlet is constituted solely by the wall orifices 8. The plenum 7 may be in the form of a box exhibiting an evacuation outlet 9 for the falling matter, as illustrated in particular on FIG. 1 or 2.

Figure 4B:
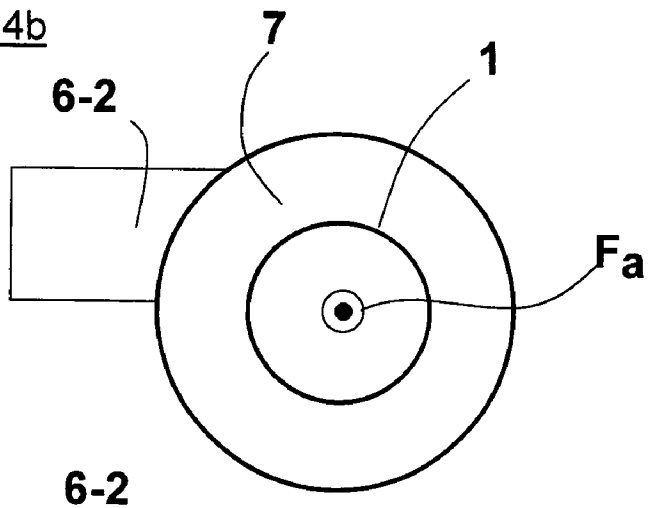
FIGS. 4*a* to 4*d* are schematic views illustrating horizontal section of diverse possibilities for injecting gas into a plenum, also called "wind box".
Figure 4D:
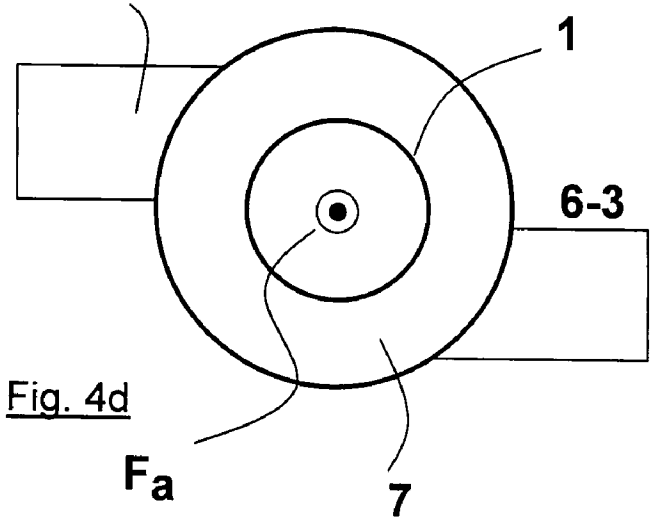
Figure 4A:
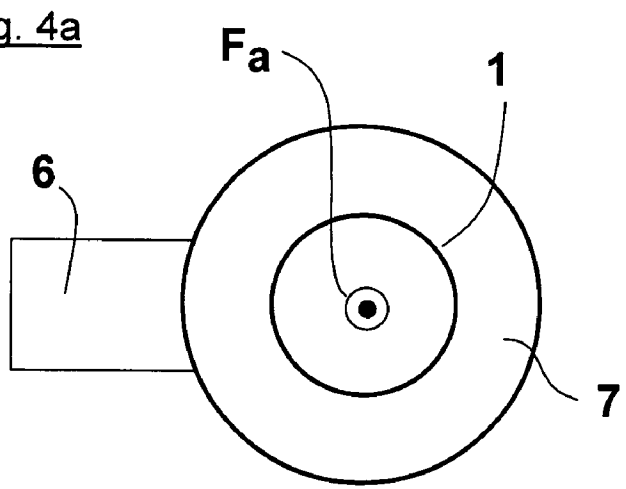
Figure 4C:
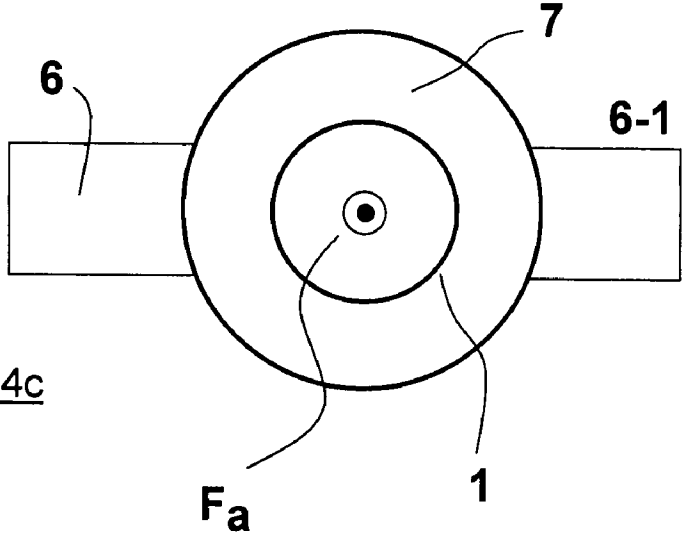

The plenum 7 may be filled with gas via of at least one radial gas inlet 6, 6-1 and/or at least one tangential gas inlet 6-2, 6-3. In particular, as illustrated on FIGS. 4*a* and 4*c*, the chamber of the plenum 7 is filled via one or two radial inlets 6; 6, 6-1. As illustrated on FIGS. 4*b* and 4*d*, the chamber of the plenum 7 is filled via one or two tangential inlets 6-2, 6-2, 6-3.

Different embodiments are described therebelow.

The embodiment illustrated on FIG. 1 includes mainly a gas pipe 1 exhibiting an upper opening 3, a lower opening 2 also forming a main gas inlet. The means 5 for creating turbulences are constituted, on the one hand, of obstacles consisting of blades 10, distributed along several successive height levels and staggered angularly along two successive height levels, and on the other hand, of wall orifices 8 letting through the wall gas flows Fp.

A single plenum will surround the lower portion of the pipe et enables to feed with gas, on the one hand, the orifices 8, et on the other hand the lower opening 2.

This apparatus may be implemented with a gas pipe whereof the length does not exceed 4 to 5 times the value of the diameter. The speed of the gas ascending flow may be 15 m/s. In this instance, the maximum grain size of matter is equal to 100 mm, with a specific concentration ranging between 5 and 6 kg/kg gas.

The plant may operate without instability and proceeds to the selection matter so that solely the particles whereof the size is smaller than 0.8 approx. will fly around and the particles whereof the size is greater than 2 mm approx. will fall. The resulting load loss is of the order of 60% relative to the "flash"-type drying system known in the art for the same matter flow rate.

The example of FIG. 2 differs from the example of FIG. 1 in that the lower opening 2 has a diameter smaller than the greatest section of the gas pipe 1, formed at the end of a cone trunk.

The example of FIG. 3 describes an apparatus wherein all the gases are introduced through the wall orifices 8 and not through the lower opening 2. The sum of the wall flows Fp then enables to create the ascending flow Fa. The wall orifices 8 are situated, largely, below blades 10 forming obstacles to the ascending flow Fa.

Figure 7:
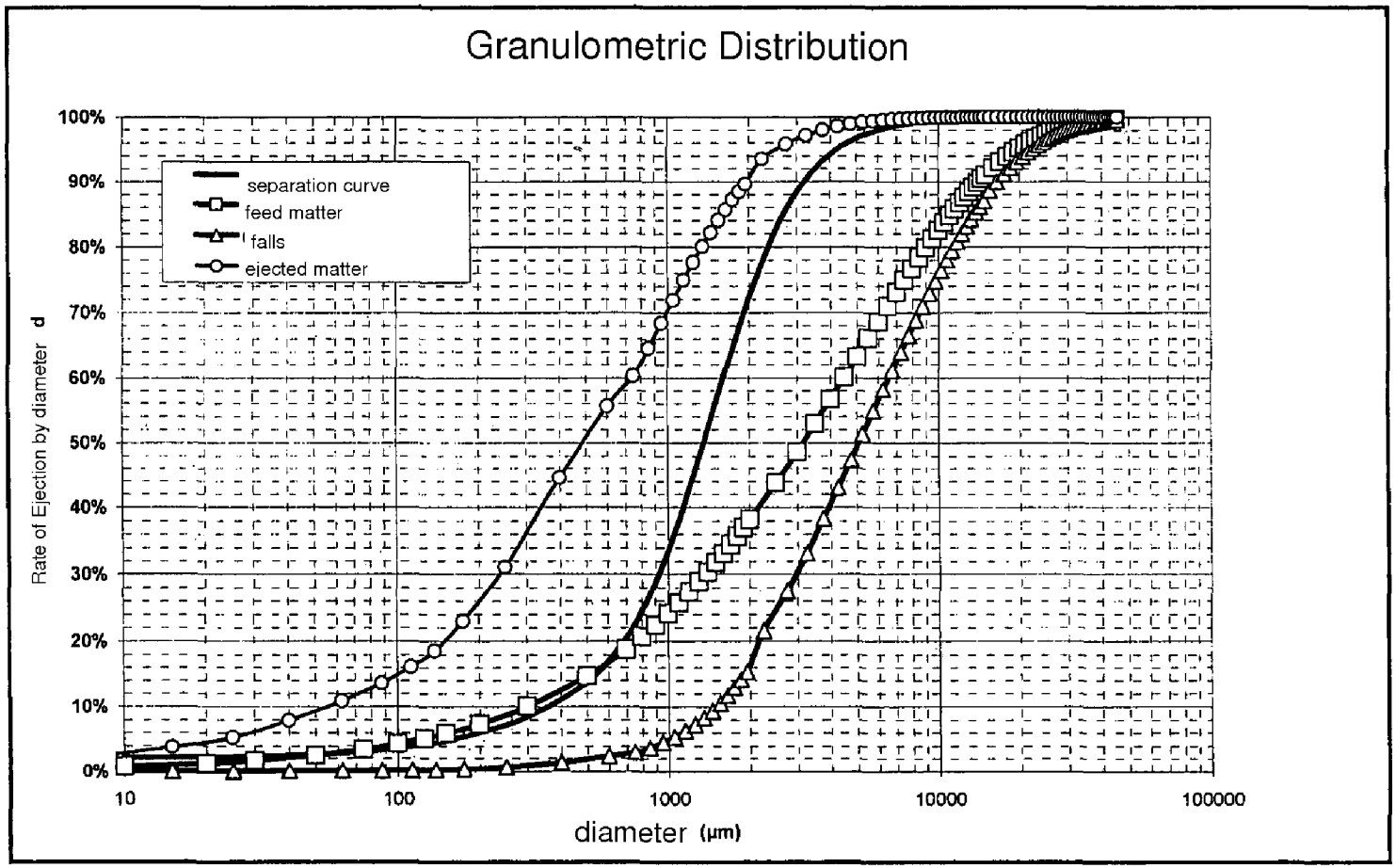
FIG. 7 is a graph illustration along a logarithmic scale enabling to illustrate the high capacities of grain size selection of the grain size selection and/or drying apparatus according to the invention.

According to the graph illustrating the separation result over a batch of matter on FIG. 7, the raw material fed into the apparatus object of the invention has such a grain size that 50% of the grains are smaller (or greater) than 3.2 mm with 10% greater than a 15 nun mesh and a maximum size of 35 mm. The specific feed rate is 5 to 6 kg/kg gas.

The matter flying towards the outlet 3 has such a grain size that most grains are smaller than 7 mm with 50% smaller (or greater) than 0.48 mm. The matter falling through the lower opening 2 is such that most grains are greater than 0.15 mm with 50% smaller (or greater) than 5 mm.

The separation curve which expresses the share ratio between both flows for each grain size shows a steep slope between the 0.7 mm grains where 20% only of matter falls and the 3 mm grains where 90% of matter falls. This steep slope expresses high selection power.

The invention also relates to a drying plant comprising an apparatus according to the invention, whereof the gas inlet is fed by a set temperature gas source.

The invention also relates to a continuous crushing plant 40, in particular for cement plant, of closed circuit type or comprising:

- a crusher 15, in particular of roll or ball type, exhibiting an inlet for products to be crushed and an outlet for crushed products,
- a selector-drier 22, consisting of a grain size selection and drying apparatus 30 with an ascending flow according to the invention, comprising a lower reject outlet 9, connected to the inlet to the crusher 15, an upper outlet for fly matter, between which a matter supply opening 4 is also provided,
- a dynamic selector 16 including at least one matter inlet connected at least to said fly matter outlet from the selector-drier 22, an outlet for the selected matter, and a reject outlet 23 connected to the inlet to the crusher 15,
- a filter 21 enabling to filter the gases loaded with matter, connected to the matter outlet of the dynamic selector 16,
- the outlet of the crusher 15 being connected 19-1 to said at least one matter inlet of the dynamic selector 16, and/or 19-2 to the supply opening 4 of the selector-drier 22,
- at least one matter supply unit 17, 18 feeding the inlet to the crusher 15 and/or the supply opening of the selector-drier 22.

Figure 6:
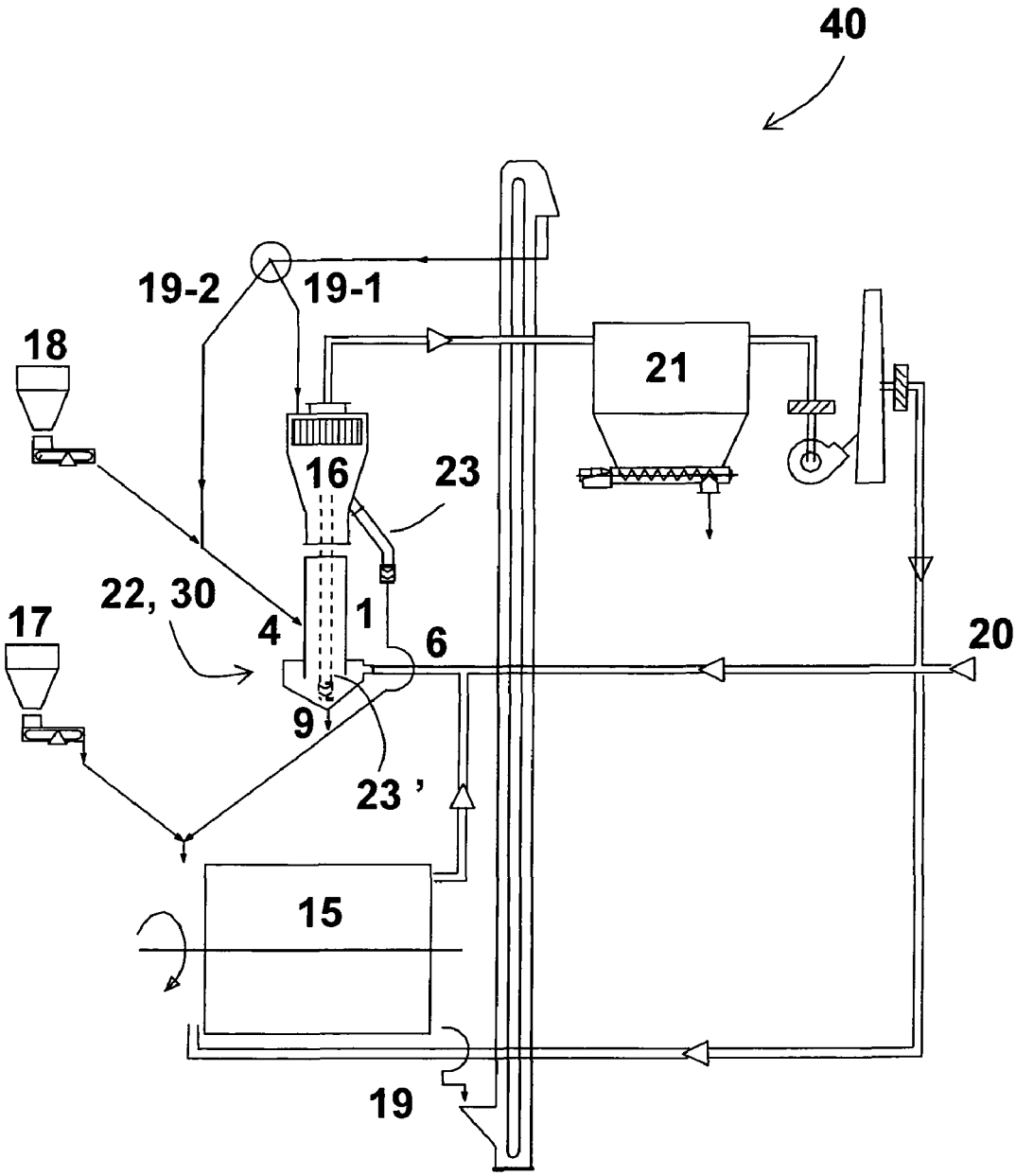
FIG. 6 is a schematic view diagrammatically illustrating a continuous crushing plant, in particular for a cement plant, of closed circuit type, incorporating a grain size selection and drying apparatus according to the invention.

FIG. 6 illustrates non-exhaustively a crushing plant incorporating a grain size selection and drying apparatus 30. This installation processes the matters 17, 18 whereof one at least is wet.

The matter-processing plant includes a crusher 15, a dynamic selector 16, a filter 21, collecting the crushed end-product, and matter-handling means such as a bucket chain or other conveyors, as well as ventilation means for the various gases. This plant receives hot gases 20 from a non-described source.

The matter supply unit 17 feeds the crusher 15, and the product 19 exiting the crusher is fed into the selector 16. The fine fraction being the end-product collected in 21 and the coarse fraction being returned to the crusher. The hot gases 20 feed the crusher 15, the selector-drier 22 and the dynamic selector 16.

In the plant described, the grain size selection and drying apparatus 30 is situated on the way of the gas feeding the dynamic selector 16 to which it is connected via its gas pipe 1. The apparatus receives the hot gases from the inlet 6 and is fed by a matter supply unit 18 for more efficient drying than if such matter were fed directly into the crusher 15.

The finest fraction progresses towards the dynamic selector 16 on the way of the gases while the coarse fraction returns via the outlet 9 towards the crusher 15 at the same time as the refuse 23 of the selector. Alternately, the refuse portion may be conveyed via a reject pipe 23' of the dynamic selector 16, arranged internally to the gas pipe 1 of the device 30 of the selector-drier 22, said reject pipe 23' emerging beneath or close to the outlet 9 of said selector-drier 22.

The selector-drier 22 may enable to select the matter whereof the grain size is smaller than approx. one millimeter, wherein the selector-drier 16 enables to select the matter whereof the grain size is smaller than approx. some hundred, possibly ten micrometers.

The grain size selection made by the apparatus 22 prevents simultaneously the dynamic selector 16 from being overloaded with coarse fractions from the suspension drying step of a traditional "flash" type system, and the crusher 15 from being overloaded with fine fractions of the new matter fed by the supply unit 18 contains a significant amount thereof. If the drying capacity of the crusher 15 is poor, the matter 19 exiting the crusher may be divided in two flows 19-1 and 19-2, the second being again subjected to the quick drying step.

Naturally, other embodiments, understandable to the man of the art, could have been contemplated without departing from the framework of the invention defined by claims below.

We claim:

1. A grain size selection and/or pulverulent matter drying apparatus, for treatment of suspended mineral particles whereof at least 90% in weight have a size less than 60 mm, the apparatus comprising:

a substantially vertical gas pipe, with an ascending flow, having a base with a lower opening, a gas inlet at said base, an upper opening, a supply opening between said lower opening and said upper opening for insertion of matter, wherein a portion of matter, called fines, can escape with the gas through the upper opening due to the bearing capacity of said ascending flow, while another portion of coarser matter is not carried away by gas and falls into the lower opening, the gas inlet is comprised of one plenum surrounding the lower portion of the gas pipe; and means for creating turbulence, favoring separation of different grain sizes and suspension of matter not immediately driven by gas at an introduction point, wherein said means for creating turbulence are situated between the lower opening and the supply opening being comprised of obstacles to the ascending gas flow, in the form of globally horizontal blades, fastened at an internal wall of the pipe, oriented longitudinally towards a center of the gas pipe, and arranged at least over two successive levels in height, staggered angularly between at least two successive levels in height, in order to stop the matter sliding along the walls of the gas pipe, and to create gas turbulence in the vicinity of the blades enabling separation of the diverse grain size fractions present as well as suspension of less coarse matter.

2. The apparatus according to claim 1, wherein the blades are concave in shape on the top of the blade or exhibit one or several greater rims on the top of the blades to favor the build-up of matter on the top of said blades, in operating mode, in order to protect said blades against erosion.

3. The apparatus according to claim 1, wherein length of the blades oriented towards the center of the pipe represents between 2% and 30% of free width of said pipe, the sum of the widths of the blades representing at least 60% of the peripheral length of said pipe.

4. The apparatus according to claim 3, wherein the sum of the widths of the blades ranges between 120% and 200% of the peripheral length of the pipe.

5. The apparatus according to claim 1, wherein said means for creating turbulences are further comprised of at least one wall gas flow, oriented globally perpendicular to the direction of the ascending flow, penetrating into the internal volume of the gas pipe through orifices in the wall of the pipe.

6. The apparatus according to claim 1, wherein said plenum enables to feed with gas the lower opening and/or the orifices in the wall of the pipe.

7. The apparatus according to claim 6, wherein the plenum is filled with gas via at least one radial gas inlet and/or at least one tangential gas inlet.

8. The apparatus according to claim 7, wherein the plenum is a box exhibiting at least one outlet for the falling matter.

9. The apparatus according to claim 1, wherein the globally horizontal blades which are staggered angularly between said at least two successive levels in height have lateral overlays forcing the ascending gas flow to zigzag between the blades of different levels.

10. A drying unit comprising:

an apparatus according to claim 1, wherein said gas inlet is supplied by a set temperature gas source.

11. A continuous crushing plant for a cement plant, of closed circuit type, comprising:

a crusher of roller or still ball type, exhibiting an inlet for the product to be crushed and an outlet for the crushed product, a selector-drier being comprised of a grain size selection and drying apparatus with an ascending flow for treatment of suspended mineral particles whereof at least 90% in weight have a size less than 60 mm, the apparatus comprising:

a substantially vertical gas pipe, with an ascending flow, having a base with a lower opening, a gas inlet at said base, an upper opening, a supply opening between said lower opening and said upper opening for insertion of matter, wherein a portion of matter, called fines, can escape with the gas through the upper opening due to the bearing capacity of said ascending flow, while another portion of coarser matter is not carried away by gas and falls into the lower opening; and means for creating turbulence, favoring separation of different grain sizes and suspension of matter not immediately driven by gas at an introduction point, wherein said means for creating turbulence are situated between the lower opening and the supply opening being comprised of obstacles to the ascending gas flow, in the form of globally horizontal blades, fastened at an internal wall of the pipe, oriented longitudinally towards a center of the gas pipe, and arranged at least over two successive levels in height, staggered angularly between at least two successive levels in height, in order to stop the matter sliding along the walls of the gas pipe, and to create gas turbulence in the vicinity of the blades enabling separation of the diverse grain size fractions present as well as suspension of less coarse matter, the selector-drier comprising a lower reject outlet, connected to the inlet to the crusher, and an upper outlet for fly matter, between which a matter supply opening is also provided, a dynamic selector comprising at least one matter inlet connected at least to said fly matter outlet from the selector-drier, an outlet for the selected matter, and a reject outlet connected to the inlet to the crusher, a filter enabling to filter the gases loaded with the selected matter, connected to the matter outlet of the dynamic selector, an outlet of the crusher being connected to said at least one matter outlet of the dynamic selector , and/or the supply of the selector-drier, and at least one matter supply unit feeding the inlet to the crusher and/or the supply opening of the selector-drier.

12. The plant according to claim 11, wherein the reject outlet of the dynamic selector comprise a reject pipe of the dynamic selector which is internal to the gas of the selector-drier, emerging below or close to the reject outlet of said selector-drier.

13. The plant according to claim 11, wherein the blades are concave in shape on the top of the blade or exhibit one or several greater rims on the top of the blades to favor the build-up of matter on the top of said blades, in operating mode, in order to protect said blades against erosion.

14. The plant according to claim 13, wherein length of the blades oriented towards the center of the pipe represents between 2% and 30% of free width of said pipe, the sum of the widths of the blades representing at least 60% of the peripheral length of said pipe.

15. The plant according to claim 14, wherein the sum of the widths of the blades ranges between 120% and 200% of the peripheral length of the pipe.

16. The plant according to claim 11, wherein said means for creating turbulences are further comprised of at least one wall gas flow, oriented globally perpendicular to the direction of the ascending flow, penetrating into the internal volume of the gas pipe through orifices in the wall of the pipe.

17. The plant according to claim 11, wherein the gas inlet is comprised of at least one plenum surrounding the lower portion of the gas pipe, enabling to feed with gas the lower opening and/or, possibly, the orifices in the wall of the pipe.

18. The plant according to claim 11, wherein the globally horizontal blades which are staggered angularly between said at least two successive levels in height have lateral overlays forcing the ascending gas flow to zigzag between the blades of different levels.

* * * * *